United States Patent [19]

Huebschen

[11] Patent Number: 4,919,020

[45] Date of Patent: Apr. 24, 1990

[54] SPRING-LOADED MAGNETIC DRIVER AND METHOD OF ASSEMBLY THEREOF

[75] Inventor: David A. Huebschen, Kenosha, Wis.

[73] Assignee: Snap-on Tools Corporation, Kenosha, Wis.

[21] Appl. No.: 370,848

[22] Filed: Jun. 23, 1989

[51] Int. Cl.[5] ..... B25B 13/02

[52] U.S. Cl. ..... 81/125; 81/124.1; 76/114; 76/119

[58] Field of Search ..... 81/124.1, 125; 76/101 D, 114

[56] References Cited

U.S. PATENT DOCUMENTS 2,671,369 3/1954 Clark .
2,677,294 5/1954 Clark .
2,834,241 5/1958 Chowning .
2,899,996 8/1959 Stockman .
3,207,010 9/1965 Wendling .
4,418,732 12/1983 Kolonia .

*Primary Examiner*—James G. Smith
*Attorney, Agent, or Firm*—Emrich & Dithmar

[57] ABSTRACT

A tool for rotatably driving a fastening member includes a hollow tubular shank closed at one end by a handle fixed thereto and having coupled to the other end thereof in communication therewith a socket for receiving an associated rotatable fastening member. A helical compression spring is disposed coaxially within the shank, having the inner end thereof embedded in a body of adhesive material and having the outer end thereof fixed to the keeper of a magnet disposed for magnetic engagement with a fastening member received in the socket. In assembly, the adhesive material is inserted in the shank in a fluid state, the inner end of the spring is immersed in the fluid, and the adhesive is then cured to a solid state.

14 Claims, 1 Drawing Sheet

SPRING-LOADED MAGNETIC DRIVER AND METHOD OF ASSEMBLY THEREOF

BACKGROUND OF THE INVENTION

1. Field of the Invention

The present invention relates to tools for rotatably driving threaded fastening members, such as nuts, screws and the like. It has particular application to driving tools having spring-loaded magnetic elements for holding the driven member in engagement with the tool.

2. Description of the Prior Art

Spring-loaded magnetic nut drivers are known in the art. Heretofore, they have typically utilized a spring-loaded magnet which is carried by the driving socket, which socket may in turn be removably mountable on an associated driving shank, such as in a ratchet wrench set. One such arrangement is disclosed in U.S. Pat. No. 3,207,010, wherein the spring is mechanically coupled to the socket by having one end of the spring bent to form a tip which is receivable in a complementary aperture in the socket.

It is also known to provide a magnetic socket wrench with a spring-loaded magnet trapped between a closed end of the shank and bushing or the like at the other end thereof. Such an arrangement is disclosed in U.S. Pat. No. 2,671,369. However, this requires the use of a separate bushing which will hold the assembly together, which bushing must be secured in place after the spring and magnet have been installed in the shank, which may create a difficult assembly problem.

SUMMARY OF THE INVENTION

It is a general object of the present invention to provide an improved driving tool which avoids the disadvantages of prior such tools while affording additional structural and operating advantages.

An important feature of the invention is the provision of a driving tool having a spring-loaded magnet and which is of simple and economical construction.

Another feature of the invention is the provision of a tool of the type set forth in which the spring is adhesively secured in place.

Still another feature of the invention is the provision of an improved method of assembling a tool of the type set forth.

These and other features of the invention are achieved by providing in a driving tool including a hollow tubular shank and a socket coupled to the shank at one end thereof and communicating therewith for receiving an associated rotatable fastening member, the improvement comprising: a body of adhesive material disposed in the shank and spaced from the one end thereof, a compression spring disposed in the shank and having one end thereof embedded in the body of adhesive material for fixedly mounting the spring in the shank, and a magnet coupled to the spring at the other end thereof, the spring in its normal uncompressed condition projecting from the body of adhesive material a distance such that the magnet is disposed for magnetic engagement with an associated fastening member received in the socket.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
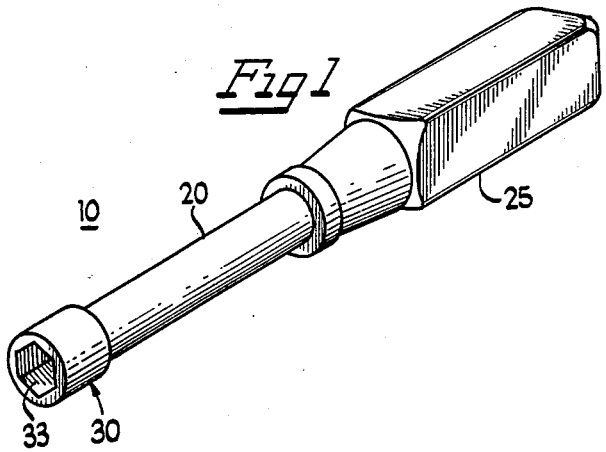
FIG. 1 is a perspective view of a driving tool constructed in accordance with and embodying the features of the present invention.
Figure 2:
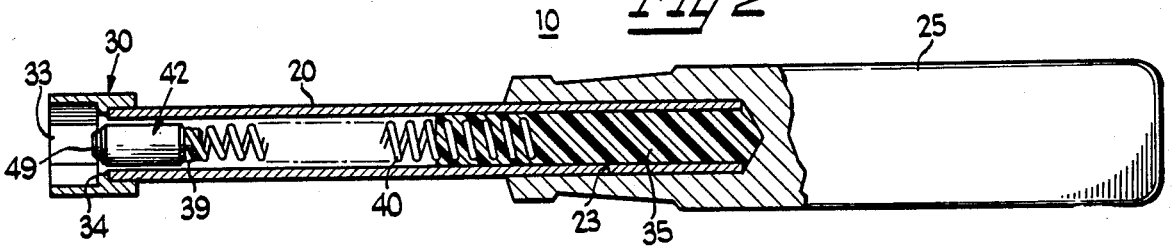
FIG. 2 is an enlarged side elevational view in partial vertical section of the tool of FIG. 1.
Figure 3:
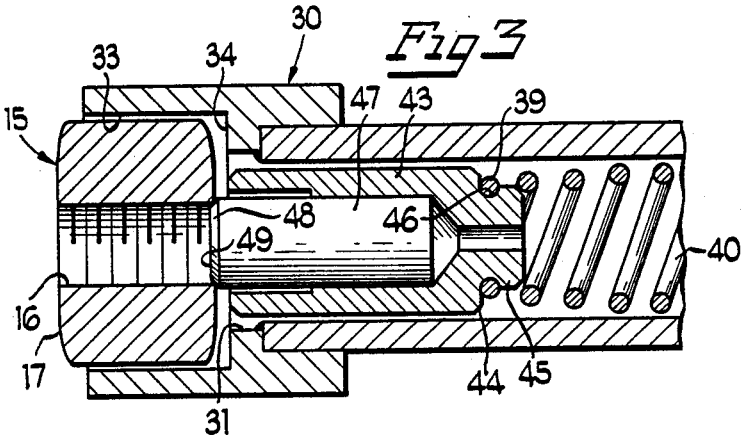
FIG. 3 is a still further enlarged fragmentary view in vertical section of the socket end of the tool of FIG. 2, illustrated with an associated nut received in the socket.
Figure 4:
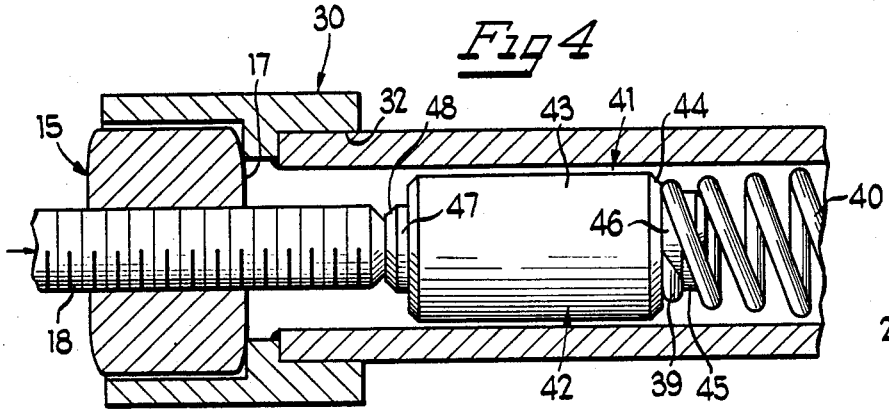
FIG. 4 is a view similar to FIG. 3 illustrating a bolt shank in threaded engagement with the nut.

Referring to FIGS. 1 and 2, there is illustrated a driving tool, generally designated by the numeral 10, constructed in accordance with and embodying the features of the present invention. The tool 10 is adapted for manually rotatably driving an associated rotatable threaded fastening member. Referring also to FIGS. 3 and 4, such a fastening member may be a nut 15 having an internally threaded bore 16 extending axially therethrough between opposed parallel end faces 17, and adapted for threaded engagement with the shank of an associated screw or bolt 18. While the tool 10 is illustrated in the drawings in connection with the driving of a nut 15, it will be appreciated that it could also be used for driving a headed fastener, such as a screw or bolt 18.

The tool 10 includes an elongated hollow tubular shank 20, which is preferably circularly cylindrical in transverse cross section, and has one end thereof received in an axial bore 23 formed in one end of an associated handle 25. The shank 20 may be fixed to the handle 25 by suitable means. Fixedly secured to the other end of the shank 20 is a socket 30 which is a generally circularly cylindrical member having an axial bore 31 therethrough provided with an enlarged-diameter counterbore portion 32 at the inner end thereof dimensioned for receiving therein the adjacent end of the shank 20 and being fixedly secured thereto by any suitable means. The bore 31 in the socket 30 is also provided with an enlarged portion at its outer end defining a receptacle 33 for mateably receiving therein an associated fastening member, such as the nut 15. The enlarged portion defines an annular shoulder 34 at the inner end of the receptacle 33 against which one of the faces 17 of the nut 15 seats in use. While, in the illustrated embodiment the receptacle 33 is hexagonal in shape for accommodating a hexagonal nut 15, it will be appreciated that the receptacle 33 could be shaped to accommodate any other shape of fastening member.

Disposed in the inner end of the shank 20 is a body of adhesive material 35. Embedded in the body of adhesive material 35 is one end of a helical compression spring 40, which is coaxially received in the shank 20. The opposite end of the spring 40 has a reduced-diameter end coil 39 which is coupled to a magnetic assembly 41. The magnet assembly 41 includes a cup-like keeper or housing 42 formed of a suitable non-magnetic material, such as brass, and including a circularly cylindrical side wall 43 closed at one end thereof by a circular end wall 44. A reduced-diameter knob 45 projects axially outwardly from the end wall 44 and has a necked-down portion which cooperates with the head 45 and the adjacent end wall 44 to define a circumferential groove or channel 46 which snugly receives the end coil 39 of the spring 40 fixedly to secure the spring 40 to the magnet assembly 41. The solid cylindrical magnet 47 is press-fitted in the keeper 42 and projects a slight distance outwardly beyond the open end thereof. The distal end of the magnet 47 is chamfered as at 48 and is provided with a flat circular end surface 49. The length of the spring 40 and its depth of insertion in the body of adhesive material 35 are such that, in use, when the spring 40 is disposed in its normal uncompressed condition, the end surface 49 of the magnet 47 projects a slight distance into the receptacle 33. The end surface 49 is preferably dimensioned to bear against the inner face 17 of an associated nut 15 which is seated in the receptacle 33 for magnetically retaining the nut 15 in place in the receptacle 33. It will be appreciated that the keeper 42 serves to magnetically insulate the magnet 47 from the shank 20 so as to ensure unobstructed axial movement of the magnet assembly 41 within the shank 20.

Referring to FIG. 4, it will be appreciated that when the nut 15 is driven into the shank of an associated bolt 18, the tip of the bolt shank engages the magnet 47 and compresses the spring 40 for thereby accommodating the shank of the bolt 18 in the shank 20 of the tool 10. Thus, it will be appreciated that the nut 15 may be driven for a considerable distance onto the shank of the associated bolt 18.

Figure 5:
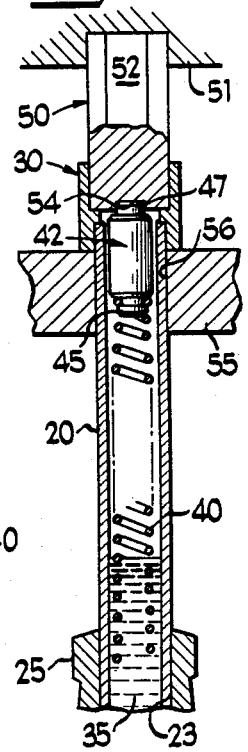
FIG. 5 is a fragmentary view, partially in side elevation and partially in vertical section, illustrating assembly of the tool of FIG. 1 with an associated assembly fixture.

Referring now to FIG. 5, the method of assembly of the tool 10 will be described. Initially, the shank 20 is preassembled to the handle 25 and the socket 30 in any desired manner. Also, the spring 40 is preassembled to the magnet 47. Then, the magnet 47 is coupled to an associated assembly fixture 50, which may be an elongated member having one end thereof adapted to be coupled to an associated holder 51 to facilitate manipulation thereof. The outer surface 52 of the fixture 50 is shaped to be mateably received in the receptacle of the socket 30. The fixture 50 has a distal end face 53 in which is formed an axial recess 54 dimensioned for receiving therein the distal end of the magnet 47. Preferably, the fixture 50 is formed of a magnetizable material, so that when the distal end of the magnet 47 is inserted in the recess 54, the magnet 47 and its associated spring 40 are magnetically held in the fixture 50, coaxially therewith.

The shank 20 is oriented vertically and may be held by an associated support 55. Thus, for example, the support 55 may have a slot 56 therein with a diameter sufficient to accommodate the shank 20, but smaller than the outer diameter of the socket 30, so that the shank 20 may be suspended by the socket 30. A volume of the adhesive 35 in a fluid state is then injected into the shank 20 through the open socket 30 until it has filled the closed handle end of the shank 20 to a predetermined depth. The distal end of the spring 40 is then inserted into the shank 20 through the socket 30 by means of the assembly fixture 50, until the end face 53 of the fixture 50 bottoms out on the shoulder 34 in the socket 30. The parts are dimensioned and arranged so that when disposed in this assembled configuration, illustrated in FIG. 5, the inner end of the spring 40 will be immersed in the body of fluid adhesive 35 to a predetermined depth, typically substantially less than half the overall length of the spring 40, and the magnet assembly 41 will be held in a predetermined position with respect to the socket 30. The adhesive 35 is then cured to a solid state, thereby to fixedly secure the spring 40 to the shank 20 with the magnet assembly 41 in its predetermined position, and the assembly fixture 50 is then disengaged from the socket 30 and the magnet 45.

The adhesive 35 may be of any suitable type, but is preferably curable in air at either ambient temperature or at an elevated temperature. However, since the driving tool 10 will commonly be used in automotive applications, such as in automotive garages or the like, the adhesive will preferably be of a type which is resistant to automotive fluids, such as gasoline, antifreeze, brake fluid, lubricating oils and the like.

From the foregoing, it can be seen that there has been provided an improved driving tool and method of assembly thereof, which are characterized by simplicity and economy.

I claim:

1. In a driving tool including a hollow tubular shank and a socket coupled to the shank at one end thereof and communicating therewith for receiving an associated rotatable fastening member, the improvement comprising: a body of adhesive material disposed in the shank and spaced from the one end thereof, a compression spring disposed in the shank and having one end thereof embedded in said body of adhesive material for fixedly mounting said spring in the shank, and magnet means coupled to said spring at the other end thereof, said spring in its normal uncompressed condition projecting from said body of adhesive material a distance such that said magnet means is disposed for magnetic engagement with an associated fastening member received in the socket.

2. The tool of claim 1, and further comprising a handle fixedly secured to the shank at the other end thereof.

3. The tool of claim 2, wherein said body of adhesive material is disposed adjacent to said handle.

4. The tool of claim 1, wherein said spring is a helical spring.

5. The tool of claim 1, wherein said magnet means is frictionally gripped by said spring.

6. The tool of claim 1, wherein the shank is formed of magnetic material, said magnet means including a magnet, and a cylindrical keeper of non-magnetic material surrounding said magnet and magnetically insulating it from the shank.

7. The tool of claim 6, wherein said keeper comprises a cylindrical body having a coupling knob at the inner end thereof, said spring being a helical spring and having an end coil wound snugly around said coupling knob.

8. A method of assembling a driving tool which includes a hollow tubular shank having a socket coupled to one end thereof in communication therewith for receiving an associated rotatable fastening member and a helical compression spring having a magnet coupled to one end thereof, said method comprising the steps of: inserting a volume of fluid adhesive material in the shank at a location spaced from the one end thereof, inserting the spring into the shank to a position wherein the magnet is disposed for magnetic engagement with an associated fastening member received in the socket and the other end of the spring is immersed in the volume of adhesive, and curing the adhesive material to a solid state, thereby fixedly to secure the spring to the shank.

9. The method of claim 8, wherein the spring is inserted into the shank from the one end thereof after the insertion of the adhesive material in the shank.

10. The method of claim 9, and further comprising the steps of coupling the magnet to an assembly fixture which is mateably receivable in the socket to a predetermined depth, and inserting the free end of the spring into the shank until the assembly fixture is disposed in the socket to said predetermined depth, thereby to control the position of the magnet with respect to the socket.

11. The method of claim 10, and further comprising the step of disposing the shank vertically, and closing the lower end of the shank for retaining the flow of adhesive material therein.

12. The method of claim 8, wherein the adhesive material is cured in ambient air.

13. The method of claim 8, wherein less than half the length of the spring is immersed in the adhesive material.

14. The method of claim 8, and further comprising the step of fixing a handle to the shank at the other end thereof for closing the other end.

* * * * *